US007913849B2

(12) United States Patent
Pedrazzi et al.

(10) Patent No.: US 7,913,849 B2
(45) Date of Patent: Mar. 29, 2011

(54) LUNCH BOX WITH CONFIGURABLE HANDLE, ACCESSORIES, CONTAINERS, AND DISPLAY INSERTS

(75) Inventors: Cynthia P. Pedrazzi, San Ramon, CA (US); Paul D. Pedrazzi, San Ramon, CA (US); Daniel K. Harden, Palo Alto, CA (US)

(73) Assignees: Cynthia P. Pedrazzi, San Ramon, CA (US); Paul D. Pedrazzi, San Ramon, CA (US)

( * ) Notice: Subject to any disclaimer, the term of this patent is extended or adjusted under 35 U.S.C. 154(b) by 0 days.

(21) Appl. No.: 12/406,893

(22) Filed: Mar. 18, 2009

(65) Prior Publication Data

US 2010/0236974 A1 Sep. 23, 2010

(51) Int. Cl.
*A45C 11/20* (2006.01)

(52) U.S. Cl. ..... 206/542; 206/541; 206/232; 206/457

(58) Field of Classification Search ..... 206/542, 206/206, 217, 223, 38.1, 541, 547, 549, 575, 206/232; D7/709; 150/108, 107, 104, 110; 224/578, 579, 103, 148.4, 582, 583, 161, 224/629, 631; 16/114.1, 406, 408, 422, 425; 190/39, 117, 105, 112, 116, 121; 220/752, 220/754, 756, 757, 759, 767, 768, 769, 770, 220/772; 394/29, 30, 81, 2, 145, 152, 158, 167, 170
See application file for complete search history.

(56) References Cited

U.S. PATENT DOCUMENTS

| | | | | |
|---|---|---|---|---|
| 1,950,118 | A * | 3/1934 | Lifton | 190/107 |
| 4,343,106 | A * | 8/1982 | Ozeki | 40/710 |
| 4,540,071 | A * | 9/1985 | Schaub et al. | 190/121 |
| 4,693,346 | A * | 9/1987 | Eversdijk | 190/111 |
| 5,100,324 | A * | 3/1992 | Slayton | 434/87 |
| 5,186,290 | A * | 2/1993 | Takayama | 190/108 |
| 5,396,999 | A * | 3/1995 | Sandheinrich | 206/542 |
| 5,718,336 | A | 2/1998 | Haarlander | |
| 6,112,899 | A * | 9/2000 | Zeringue | 206/541 |
| 7,334,684 | B1 * | 2/2008 | Fontanilla et al. | 206/541 |
| 2007/0221693 | A1 * | 9/2007 | Moore | 224/148.6 |

* cited by examiner

*Primary Examiner* — Ehud Gartenberg
*Assistant Examiner* — Ernesto A Grano
(74) *Attorney, Agent, or Firm* — Patent Law Group LLP; David C. Hsia

(57) ABSTRACT

A lunch box system includes a hollow body, two lids, a handle, and interchangeable display inserts. The hollow body has an external rib around the sides of the hollow body. The external rib defines holes along its length. The handle detachably secures to any two of the holes. The lids cover the open ends of the hollow body and each has tabs on their exterior for detachably securing the display inserts. Other accessories may also be detachably secured to the holes of the external rib.

12 Claims, 5 Drawing Sheets

LUNCH BOX WITH CONFIGURABLE HANDLE, ACCESSORIES, CONTAINERS, AND DISPLAY INSERTS

FIELD OF INVENTION

This present disclosure relates to a lunch box system.

DESCRIPTION OF RELATED ART

The lunch box, also referred to as a lunch pail or lunch kit, is a container for storing a meal. The lunch box is often used by schoolchildren to take packed lunches from home to school. The lunch box is typically a small case with a clasp and handle, often printed with a colorful image that can either be generic or based on children's television shows or films.

SUMMARY

In some embodiments of the present disclosure, a lunch box system includes a hollow body, two lids, a handle, and interchangeable display inserts. The hollow body has an external rib around all sides of the hollow body. The external rib defines holes along its length. The handle detachably secures to any two of the holes. The lids cover the open ends of the hollow body and each has tabs on their exterior for detachably securing the display inserts. Other accessories may also be detachably secured to the holes of the external rib.

BRIEF DESCRIPTION OF THE DRAWINGS

Use of the same reference numbers in different figures indicates similar or identical elements.

DETAILED DESCRIPTION

Figure 1:
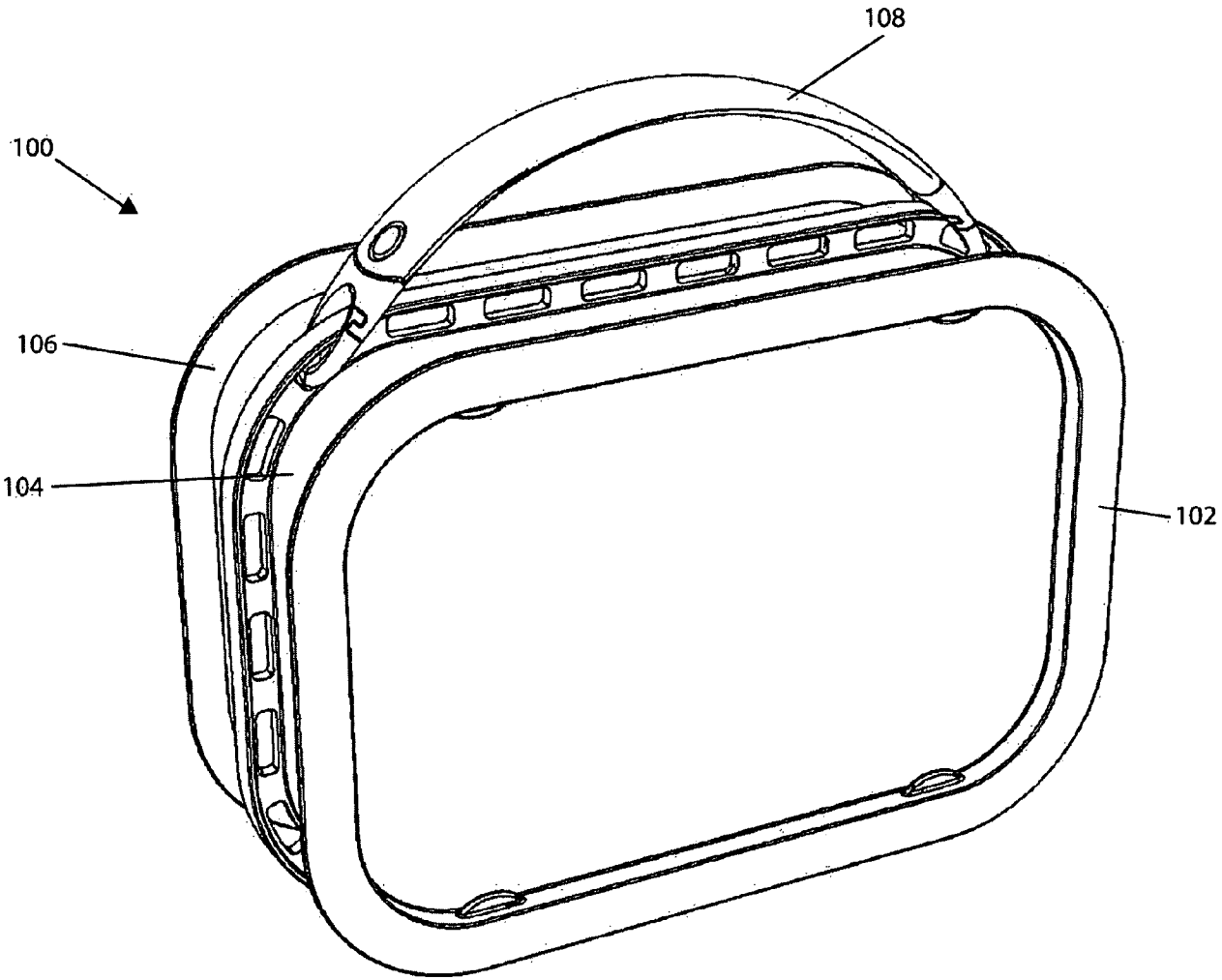
FIG. 1 illustrates assembled perspective view of a lunch box system.
Figure 2:
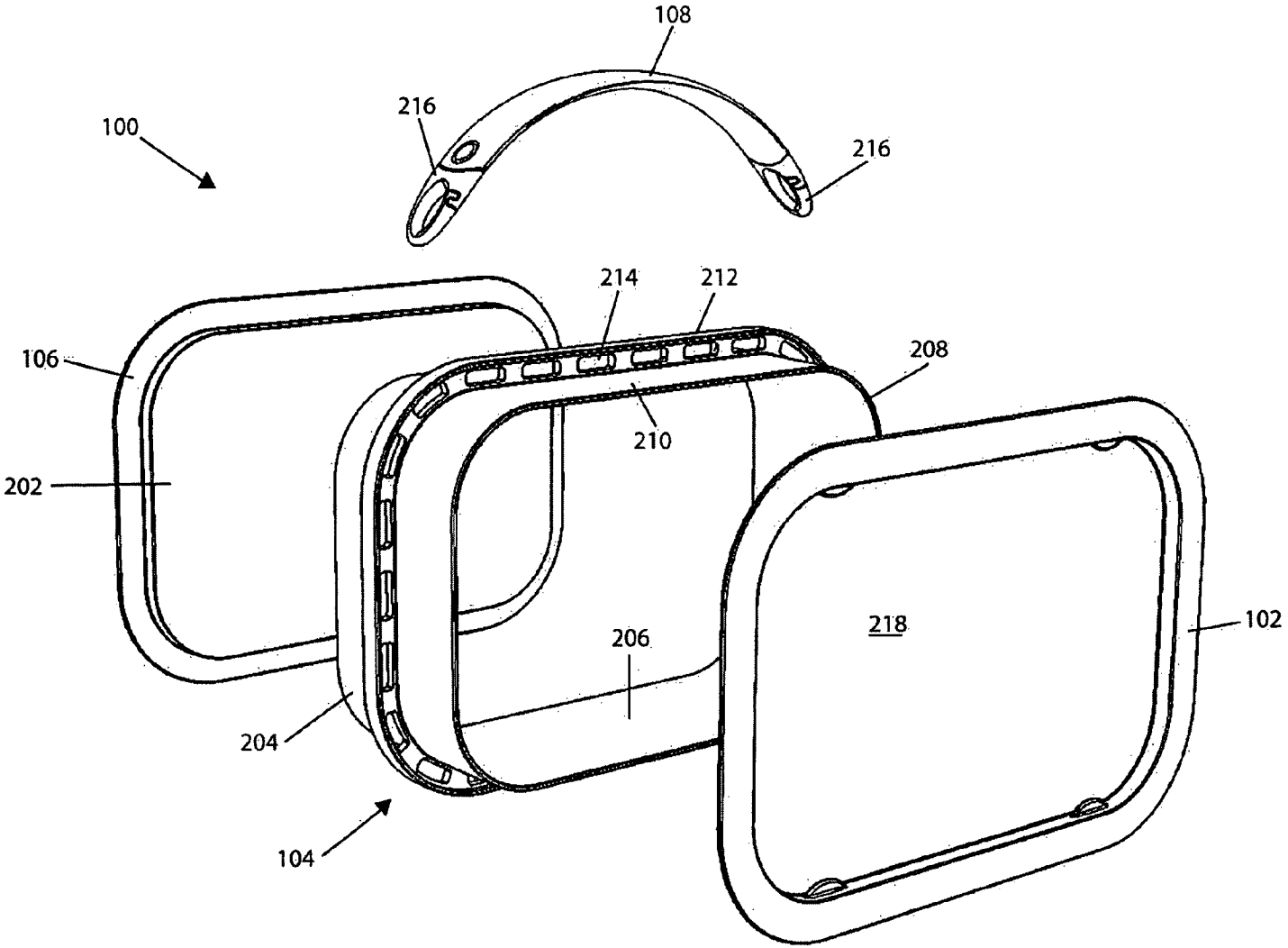
FIG. 2 illustrates an exploded perspective view of the lunch box system.

Embodiments of the present disclosure provide a configurable lunch box system that can be personalized by the user. FIGS. 1 and 2 show a lunch box system 100 in some embodiment of the present disclosure. Lunch box system 100 includes a first lid 102, a hollow body 104, a second lid 106, and a handle 108. Lids 102 and 106 are of similar or identical construction. Lid 102, hollow body 104, and lid 106 may be made from materials commonly used in Tupperware. Lid 102, hollow body 104, and lid 106 may be thermally insulated.

Referring to FIG. 2, hollow body 104 includes sidewalls 204, 206, 208, and 210 that define two open ends of the hollow body. Each lid has a protrusion 202 (only visible for lid 102) that friction fits into one open end of hollow body 104 to form a closed container. An external rib 212 extends from the exterior surface of sidewalls 204 to 210. External rib 212 defines holes 214 (only one is labeled for clarity) that are located all the way around hollow body 104.

Handle 108 has snap hooks 216 that clip onto any two holes 214 of external rib 212. This allows the user to personalize lunch box system 100 by changing the attachment points of handle 108 and the orientation of the lunch box system. Each snap hook 216 is a loop with a spring loaded gate that can be clipped onto a hole 214 in external rib 212.

Figure 3:
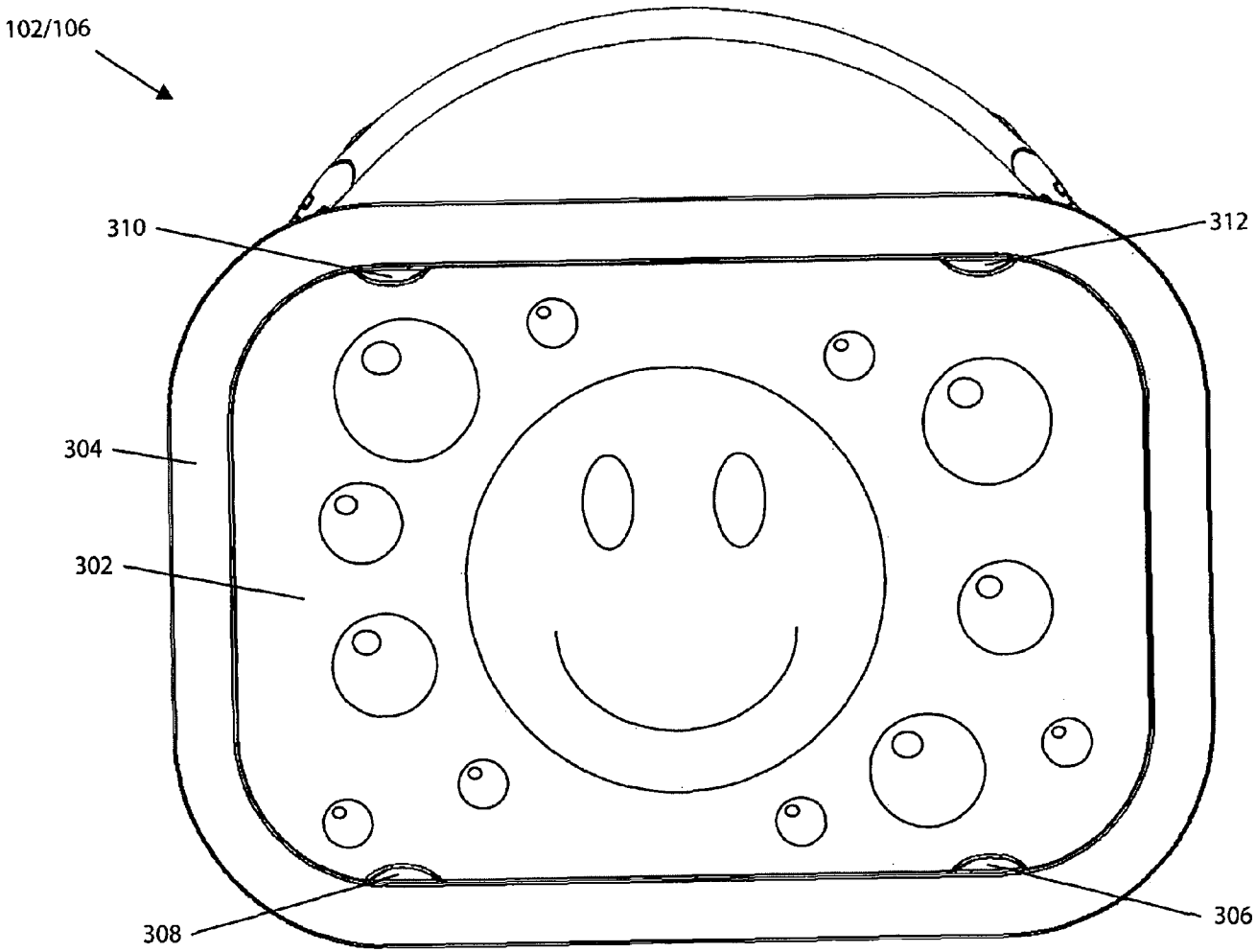
FIG. 3 illustrates a front view of the lunch box system with an example display insert.

Lids 102 and 106 each includes a depression 218 (only visible for lid 102) for seating a display insert. Referring to FIG. 3, an interchangeable display insert 302 is seated in depression 218 (FIG. 2). Each lid further includes tabs 306 and 308 along the bottom edge of a rim 304 around depression 218, and tabs 310 and 312 along the top edge of the rim. Display insert 302 is slid into and then secured by tabs 306 and 308, and then slid into and then secured by tabs 310 and 312, or vice versa. Display insert 302 may be a laminated card bearing indicia such as photos, cartoon characters, superheroes, movie or television stars, logos, symbols, and other designs. The user can replace display insert 302 with another to personalize lunch box system 100.

Figure 5:
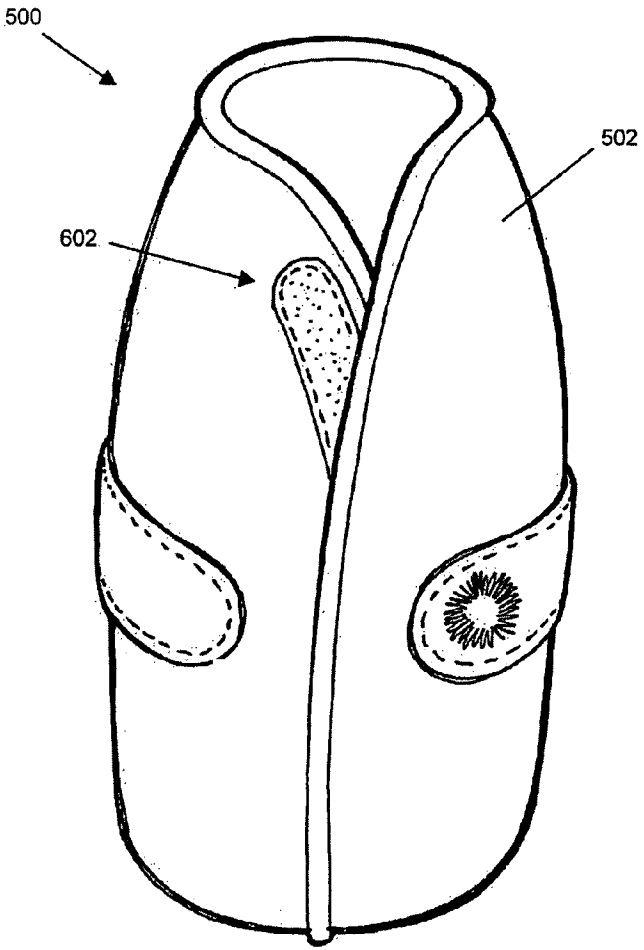
FIG. 5 illustrates a perspective front view of the example accessory to the lunch box system.
Figure 4:
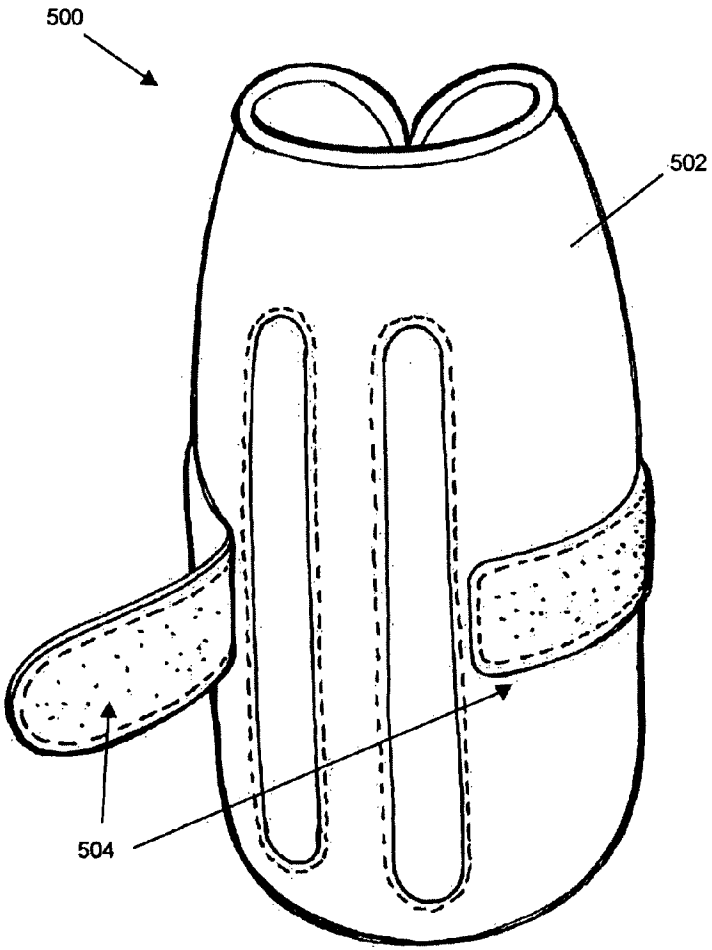
FIG. 4 illustrates a perspective back view of an example accessory to the lunch box system.

FIGS. 4 and 5 illustrate an example accessory, such as a drink holder 500, that may be detachably secured to any two of the holes 214 of external rib 212 in some embodiments of the present disclosure. Drink holder 500 includes a substantially cylindrical body 502 for receiving a drink, and hook-and-loop fasteners 504 on the cylindrical body. The loose ends of the hook-and-loop fasteners 504 may be looped through any of the holes 214 of external rib 212 and then fastened to the stationary ends of the fastener to detachably secure drink holder 500 to external rib 212. This allows the user to not only add or remove a drink holder 500 from lunch box system 100 but also personalize the attachment point of the drink holder. Referring to FIG. 5, cylindrical body 502 has a vertical opening that may be opened or closed via a hook-and-loop fastener 602 in order to receive or remove a drink from the body.

Figure 6:
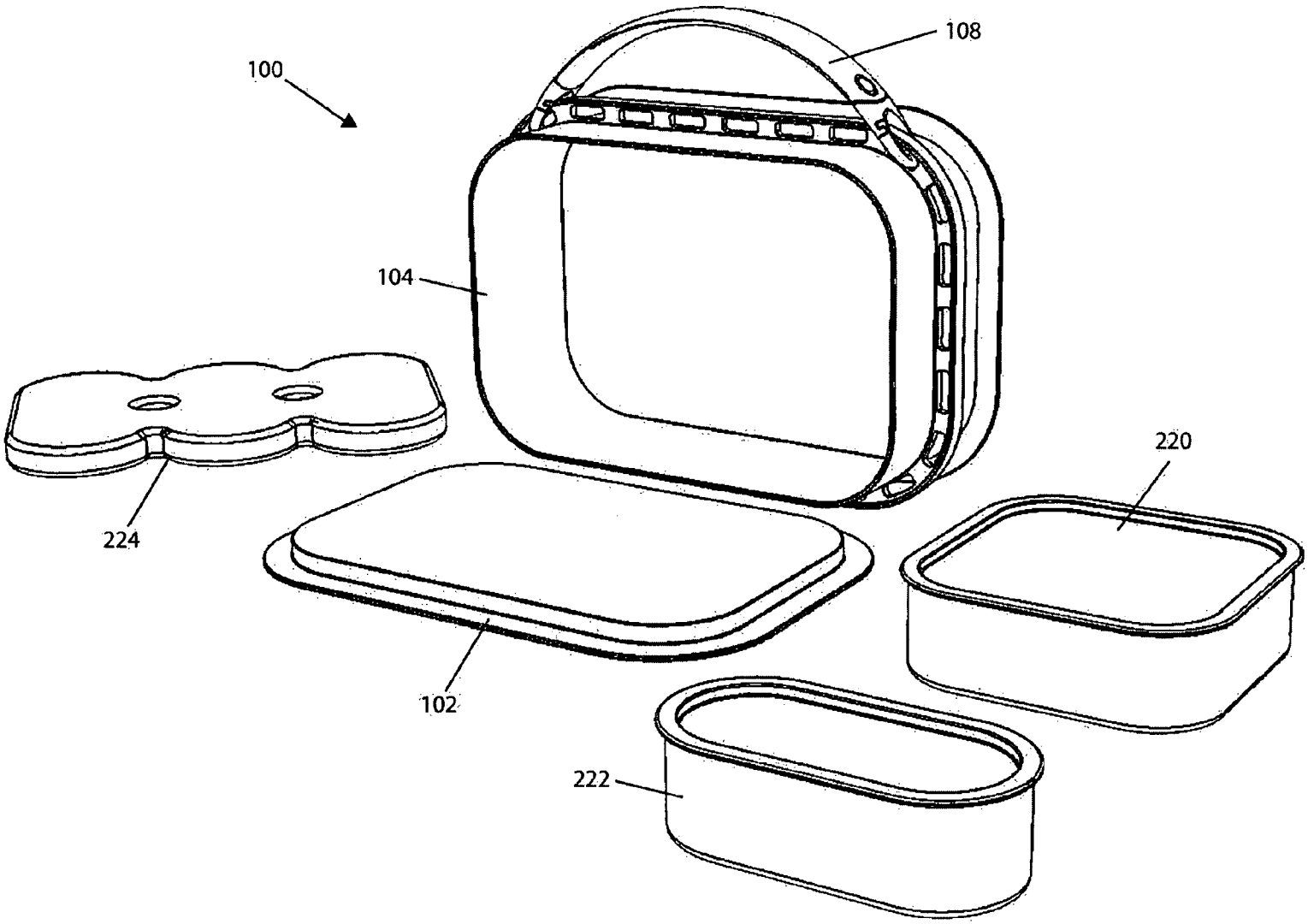
FIG. 6 illustrates food containers and a temperature control pack for the lunch box system, all arranged in accordance with embodiments of the present disclosure.

FIG. 6 illustrates that lunch box system 100 houses food containers 220 and 222 and a temperature control pack 224 (e.g., an ice pack) in some embodiments of the present disclosure. Food containers 220 and 222 fit side by side in hollow body 104, and temperature control pack 224 fits in the hollow body and sits above or below the food containers.

Various other adaptations and combinations of features of the embodiments disclosed are within the scope of the present disclosure. For example, instead of being open on both ends, hollow body 104 may have a closed bottom with an open top. Instead of being friction fit, lid 102 and 106 may be locked by latches along multiple edges, or the lid may be hinged to hollow body 104 and locked by one or more latches. Instead of being a rectangular with rounded corners, hollow body 104 may be square, round, or another shape. Instead of using snap hooks 216, handle 108 may use other types of fasteners, such as a snap fastener with a head that snap fits into any of the holes 214 of external rib 212. Instead of locating tabs 306 to 312 along the edges of rim 304, the tabs may be located at the corners of the rim. Instead of or in addition to a drink holder 500, other accessories such as a nametag holder, a drink container (e.g., a water bottle), a plush toy, a figurine, a trinket, and a piece of jewelry may be detachably secured to any of the holes 214 of external rib 212. Instead of the hook-and-loop fasteners 504, the accessories may use snap hooks and other types of fasteners. Numerous embodiments are encompassed by the following claims.

What is claimed is:

1. A lunch box system, comprising:

a hollow body, comprising sidewalls that define two open ends; and an external rib extending perpendicularly from exterior lateral surfaces of the sidewalls and all around said sidewalls, the external rib comprising a plurality of holes uniformly spaced all the way around the entire exterior of the hollow body, the holes being defined into a plane perpendicular to the exterior lateral surfaces of the sidewalls;

two friction fit lids that cover the two open ends of the hollow body, wherein friction fit is the only fastening for the two friction fit lids to the hollow body; and a handle detachably secured to two of the holes residing on the external rib.

2. The lunch box system of claim 1, wherein the two friction fit lids each defines a depression and comprises tabs along a rim around the depression, the lunch box system further comprising:

interchangeable display inserts seated in the depressions and detachably secured by the tabs.

3. The lunch box system of claim 2, wherein each friction fit lid comprises:

a protrusion that friction fits into an open end of the hollow body; and a rim around the protrusion.

4. The lunch box system of claim 2, further comprising an accessory detachably secured to the external rib.

5. The lunch box system of claim 4, wherein the accessory is a drink holder.

6. The lunch box system of claim 4, wherein the accessory is selected from the group consisting of a nametag holder, a drink container, a plush toy, a figurine, a trinket, and a piece of jewelry.

7. The lunch box system of claim 1, wherein the handle has two snap hooks that detachably secures the handle to the two of the holes residing on the external rib.

8. The lunch box system of claim 1, wherein hollow body and the two friction fit lids comprise a dishwasher safe plastic.

9. A lunch box system, comprising:

a hollow body, comprising:

sidewalls that define two open ends; and an external rib extending perpendicularly from exterior lateral surfaces of the sidewalls and all around said sidewalls, the external rib comprising a plurality of holes uniformly spaced all the way around the entire exterior of the hollow body, the holes being defined into a plane perpendicular to the exterior lateral surfaces of the sidewalls;

two friction fit lids that cover the two open ends of the hollow body, wherein friction fit is the only fastening for the two friction fit lids to the hollow body;

a handle detachably secured to two of the holes residing on the external rib; and a drink holder, comprising:

a cylindrical body for receiving a drink; and a hook-and-loop fastener on the cylindrical body that detachably secures the drink holder to one of the holes residing on the external rib.

10. A lunch box system, comprising:

a hollow body, comprising:

sidewalls that define two open ends; and an external rib extending perpendicularly from exterior lateral surfaces of the sidewalls and all around said sidewalls, the external rib comprising a plurality of holes uniformly spaced all the way around the entire exterior of the hollow body, the holes being defined into a plane perpendicular to the exterior lateral surfaces of the sidewalls;

two friction fit lids that cover the two open ends of the hollow body, wherein friction fit is the only fastening for the two friction fit lids to the hollow body;

a handle detachably secured to two of the holes residing on the external rib; and food containers that fit in the hollow body.

11. The lunch box system of claim 10, wherein the food containers fit side-by-side within the hollow body.

12. The lunch box system of claim 11, further comprising a temperature control pack that fits in the hollow body and sits above or below the side-by-side food containers.

* * * * *